United States Patent [19]

Plantèn et al.

[11] Patent Number: 4,486,914

[45] Date of Patent: Dec. 11, 1984

[54] TOOTH BRUSH FOR CLEANING AND CARE OF THE TEETH

[76] Inventors: Staffan Plantèn, Parkstrasse 15, 7064 Remshalden-Buoch; Torbjörn Askeroth, Gustav-Blickle-Strasse 9, 7472 Winterlingen, both of Fed. Rep. of Germany

[21] Appl. No.: 473,374

[22] Filed: Mar. 8, 1983

[30] Foreign Application Priority Data

Jul. 16, 1982 [DE] Fed. Rep. of Germany ..... 3226656
Nov. 16, 1982 [DE] Fed. Rep. of Germany ... 8232150[U]

[51] Int. Cl.[3] ..... A46B 00/00
[52] U.S. Cl. ..... 15/167 A; 128/62 A
[58] Field of Search ..... 15/110, 167 R, 167 A; 128/62 A

[56] References Cited

U.S. PATENT DOCUMENTS 348,508 8/1886 Barber ..... 15/167 X
1,111,144 9/1914 Epstein et al. ..... 15/167 A
2,283,686 5/1942 McCune ..... 15/167 A
3,146,478 9/1964 Rosenthal ..... 128/62 A

FOREIGN PATENT DOCUMENTS 325149 9/1920 Fed. Rep. of Germany ... 15/167 A
410701 5/1934 United Kingdom ..... 128/62 A

*Primary Examiner*—Peter Feldman
*Attorney, Agent, or Firm*—Flynn, Thiel, Boutell & Tanis

[57] ABSTRACT

A tooth brush is of generally tongs-like or horseshoe-like form with two arms that may be pressed elastically together for pressing brush members at their ends against the inner and outer faces of the teeth. The brush members are placed at an angle to the arms. In order to make possible full and complete brushing and care of the teeth, and more specially for the spaces between the teeth to be cleaned out and for the edges of the gums to be brushed and massaged, the brush members are each formed by a round brush with bristles running out from a support pin or core. The end of each support pin furthest from said arm has bristles directed towards the gums and gum edges.

15 Claims, 8 Drawing Figures

TOOTH BRUSH FOR CLEANING AND CARE OF THE TEETH

BACKGROUND OF THE INVENTION

1. Field of the Invention

This invention relates to a tooth brush.

The present invention is with respect to tooth brushes for cleaning the teeth, that is to say clearing incrustations of foreign matter therefrom and for the general care of natural teeth. More specially, the present invention has to do with tooth brushes of the sort having a handle made up of two more or less parallel parts like arms that may be elastically moved towards each other in the hand and which at their ends each have a brush member with bristles that are placed at an angle to a common plane of the two arms, such brush members being placed opposite each other so that they may be used for brushing the inner and outer sides of teeth at the same time.

It is a well-known fact that human teeth are in need of vigorous cleaning and frequent care as a safeguard against common diseases such as caries and pyorrhea Such damage to the inorganic hard substances of the enamel and such diseases of the alveolar bone and loosening of the teeth are caused by tartar and like incrustations from bacteria and their products, that are a danger to health.

2. Summary of the Invention

One purpose of the present invention is that of designing a tooth brush with a handle in the form of two arms and with brush members at their ends, which may be used for fully and completely freeing the teeth of incrustations and for care of the teeth even at points where the teeth are hard to get at and more specially between the teeth and on the gums. A further purpose of the invention is designing such a two-armed tooth brush that may be manufactured at a low price.

For effecting these and further purposes that will be made clear on reading the present account of the invention, the two brush members are each formed by a cylindrical round brush with bristles running out from a support pin fixed to the handle part, the free end, furthest from the handle part, of the support pin having bristles whose direction is such that when used they are pointed towards the gum.

In use, the two arms of such a tooth brush are opened up somewhat so that the brush members are on the two sides of the teeth and the brush is then moved backwards and forwards in a vertical or horizontal direction. At the same time the two arms of the handle are pushed in the hand together elastically so that the teeth are cleaned at one and the same time on their front and back sides and furthermore the part of the gums next to the teeth may be brushed. The arms being elastic in nature, the spacing between the round brushes becomes automatically matched to the thickness of the teeth at a given point so that in fact the brush members are guided along the rows of teeth in the right direction. One may be certain in fact of rubbing along the front and back sides of the teeth without the brush slipping off the teeth and furthermore the spaces between the teeth will be cleaned out by the bristles because round brushes are used. A further point is that the bristles sticking out from the free end of the support pin may be used for brushing the gum next to the teeth, this being a safeguard against the building up of incrustations here where they are likely to be a great danger to the health of the teeth.

Further useful effects and other details of the invention will be seen from the account now to be given using the figures herein.

DESCRIPTION

Figure 6:
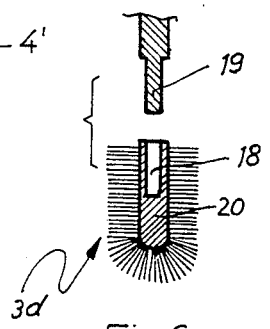
FIG. 6 is view of a brush member by itself in lengthways section and on a larger scale.

The tooth brushes to be seen in the figures are designed for clearing incrustations from human teeth and for care of the dentition in other respects. In all the examples the tooth brush has a handle part (1 in FIG. 1 and 1*a* in FIG. 4) that is gripped in the hand. At the end of the handle part 1 or 1*a* and 1*b* there is a brush array (2 in FIGS. 1, 2 and 3, 2*a* in FIG. 4 and 2*b* in FIG. 5), that is made up of two spaced brush members (3, 3' in FIGS. 1 and 2*a*, 3*a*, 3'*a* in FIG. 4, 3*b* and 3'*b* in FIG. 5, 3*d* in FIG. 6 and 3*e* in FIGS. 7 and 8), such brush members being round. The brush members have normal bristles that are pressed in holes or fixed in place in some other way. If the brush members are made of synthetic resin the brush core and the bristles may be molded in one piece.

The handle part 1 or l*a* is made in the form of two arms pointing in generally the same direction. Each arm (4 and 4' in FIG. 1, 4*a* and 4'*a* in FIG. 4 and 4*b* and 4'*b* in FIG. 5) has its brush member fixed to it so as to be at a slope in relation to the common plane of the two arms, the two arms running from a point at which they are joined together separately to their brush members. The arms may be pushed together somewhat when gripped in the hand. For reasons of manufacture the best material for the arms is synthetic resin. It will be clear that when the two arms are acted on by pushing forces on their outer sides, they will be moved together somewhat elastically so at the distance between the brush members 2, 2*a* or 2*b* will be as needed for brushing the teeth on the two sides thereof. Then it will only be necessary for the arms to be pressed somewhat by the fingers for elastically pushing the brush member 3, 3*a* or 3*b* against the front side of the teeth for example and pressing the other brush member 3', 3'*a* or 3'*b* against the back side of teeth. By moving the brush members backwards and forwards on the level or up and down (arrow 5 or 6 in FIG. 3) the two sides of the teeth may then be brushed at one and the same time, the force used on the teeth being under the control of the user. The effect so produced is very efficient and even makes it possible for the teeth to be cared for and kept clean without the use of a dentifrice. In the resting or unused position the brush members 3, 3', 3 *a*, 3'*a*, 3*b*, 3'*b*, 3*d* and 3*e* as the case may be, will be, possibly, at a smaller distance from each other than the thickness of the teeth so that when the arms 4, 4', 4*a*, 4'*a*, 4*b*, 4'*b* are slipped over the teeth on the two sides thereof they will have to be opened out somewhat, this being done by putting a finger between the arms if necessary.

Figure 3:
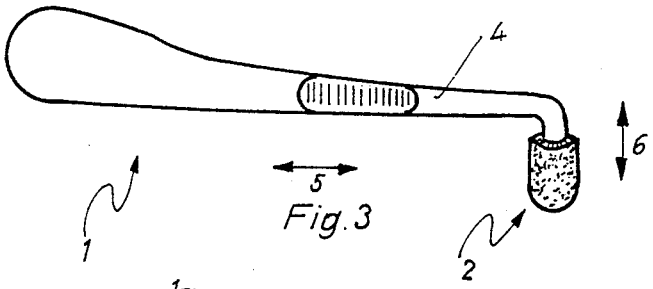
FIG. 3 is a side view of the tooth brush of FIG. 1 looking in the direction III.

It will be seen from the side view of FIG. 3 that the two brush members 3, 3' are each placed at an angle of about 90 degrees on the arms 4 and 4', so that when the brush is looked at from the side it will seem to generally have the form of a letter L. This makes it simpler for the brush to be put into and taken out of the mouth and the handle 1 may readily be kept in a level position when gripped in the hand, so that the brush members are parallel to the tooth, something which is useful with respect to cleaning between the teeth.

If the brush is moved along on the level the brush members will be moved along in the length direction of the rows of teeth rubbing the surfaces thereof. If the brush is moved upwards and downwards the spaces between the teeth will be cleaned out. In any case, whichever of these ways the brush is used, the gum next to the teeth will be brushed as well seeing that the brush members 3 and 3' stick out far enough. A further point is that because the brush members are pressed against the teeth from the two sides thereof, the tooth brush will be guided.

In each of the different forms of the invention the two brush members 3, 3' and so on, are placed at a slope so that their lengthways or longitudinal axes are at an acute angle to each other, the best value of the angle (marked $\alpha$ in FIG. 2) being between 20 deg and 30 deg. This makes certain that the form of the brush is matched to the parts of the teeth next to the gums and for this reason one may be certain that there is a good brushing effect on the upper limits of the gums round the teeth, where cleaning is all-important inasfar as there is a chance of an incrustation of foreign matter builiding up here so that pockets are formed under gums and there is then atrophy of the gums. At the same time the gums are massaged as the teeth are cleaned.

Each handle part 1, 1*a* and 1*b* has the form of one half of a horseshoe, although they are somewhat more parallel to each other than the two sides of a horseshoe. The curved part of the brush joining the two arms, that is to say at the end opposite to the brush members 3 and 3' etc, is in the form of half circle 7 (see FIG. 1). It will be seen that the two arms 4, 4' etc, have parts 8, 8' that are preferably parallel and have the brush members fixed thereto. The arms 4, 4' etc define a first common plane. The distance between the two parts 8 and 8' of the arms is smaller than the diameter of the circle 7. It will be seen in fact that in each case the one half of the circle together with base members or the arm 4, 8 or 4', 8' takes the form of one half of the tooth brush. Each such half is made in one piece and is of generally round cross section. The two outer ends 8 and 8' or parts are made thinner than the material forming the circle 7. The handle part so formed may readily be gripped in the hand with the index and/or the middle finger placed between the arms 4 and 4', whereas the rest of the fingers are placed round the brush so that the two brush members 3 and 3' may readily be pulled towards each other or be opened out using the arms 4 and 4' without a change in the way of gripping the brush being necessary. Furthermore the tooth brush may be readily placed on a hook on the wall when not in use with its two arms hanging downwards, the brush members then drying in the air.

Figure 1:
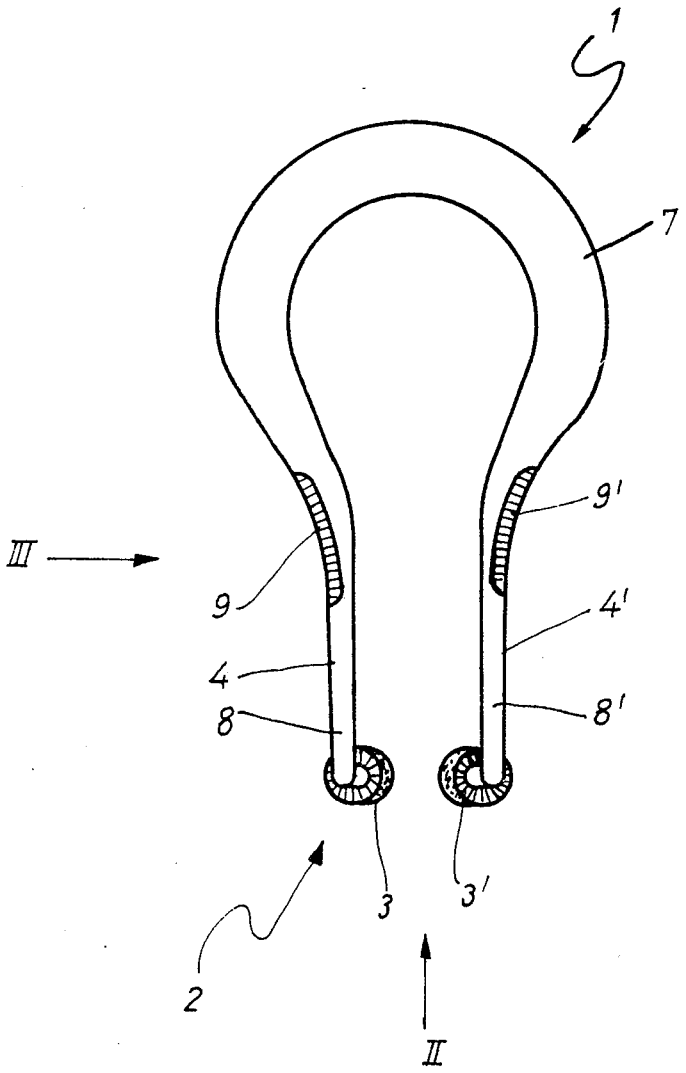
FIG. 1 is a view of a first working example of the invention in the form of a tooth brush in keeping with the invention looking in a downward direction.

A change may be made in the design of FIG. 1 inasfar as the handle part would in the first place be made of a straight piece of material which would then be cut for some of its length so that the two arms would be formed on the two sides of the cut. Furthermore the handle may be made in the form of tweezers or tongs. The outer face of the arms 4 and 4' made be grooved as at 9, 9' so that it would be able to be more readily gripped between the fingers.

As noted earlier the brush members 3, 3'; 3*a*, 3'*a*; 3*b*, 3'*b* and 3*d* 3'*d* are like cylinders in form. While in this connection the round brushes 3, 3' and 3*b*, 3'*b*, will have bristles all the way round them, the two round brushes may be free of bristles on their sides turned away from each other, even at the parts thereof next to the handle parts. The outcome of this is not only a saving in material but furthermore less space is taken up, this being important in view of the small amount of space in the mouth for brushing motion and with such a design it will in fact be simpler for the tooth brush to be moved to parts of the teeth that are otherwise hard to get at. These very useful developments of the invention will be seen from FIGS. 4, 7 and 8. In other words, the bristles extend outwardly of the upright sides of the brush members and terminate in a first convex arcuate array when viewed along the longitudinal axis of the brush members, outwardly of a downwardly facing side in a second convex arcuate array when viewed in a direction parallel to a second common plane defined by the longitudinal axis of said brush members, and in a third convex arcuate array when viewed in a direction perpendicular to the second common plane.

In all forms of the invention the free ends of the brush members 3, 3' etc furthest from the handle part however have bristles—something that is not possible in normal tooth brush designs—so that such parts may be used for care of the gums and stopping any incrustation from being formed on the teeth at the limits of the gums. Whereas the bristles are placed sticking out radially from the brush members as far as the free ends thereof, at the ends themselves they are directed downwards at a slope.

Figure 2:
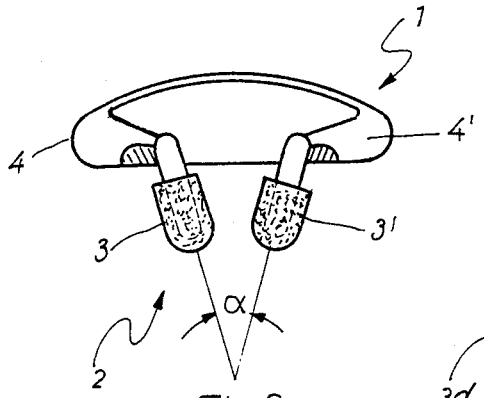
FIG. 2 is an end-on view of the tooth brush of FIG. 1 looking in the direction of the arrow II therein.
Figure 4:
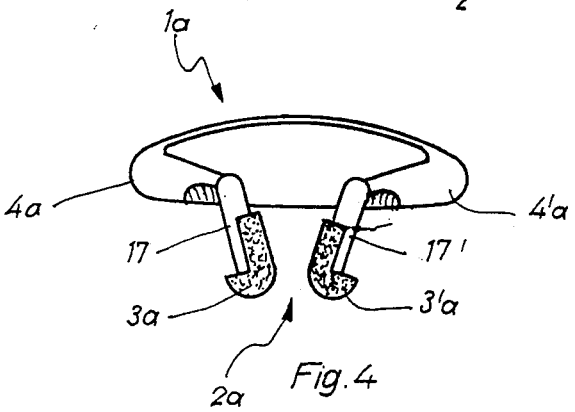
FIG. 4 is an end-on view of somewhat a changed form of the tooth brush.

The form of the invention of FIG. 4 is the same as that of FIGS. 1 to 3 but for the fact, as noted, that the brush members 3*a* and 3'*a* do not have bristles all the way round them.

The bristles of the round brushes may furthermore be made in one piece with support pins 17 and 17' or cores (see FIG. 4) on the handle part. The brush members made up of the base members or support pins and the bristles may however be undertaken separately or in two stages. Such a brush member 3*d* in the form of a round brush is to be seen in FIG. 6. Once again the bristles are here fixed on a base or a middle support pin 20 that is made of metal or, better, synthetic resin. This support pin has a blind hole 18 to take up a brush supporting member or peg 19 sticking out from the handle part and on one side of the first common plane. It would naturally be possible for the peg to be formed on the support pin and the blind hole would then be on the handle part (see FIGS. 7 and 8) The connection between the parts may be made by adhesive for example, although the join might be such that it would be able to be undone and the brush members taken off the handle part when they are worn and new ones put on in their place. For this purpose as well the system of FIG. 6 or the brush member as in FIGS. 7 and 8 might be used. It would only be necessary to have a force fit between the blind hole 18 and the peg 19 so that the parts would be able to be taken off by hand. Detents or catches would be possible as well. Whatever the design however, care is to be taken to see that the brush member may not be turned. To make certain of this the blind hole 18 and the peg 19 might have an unround cross section, as for example a square cross section. This would go for the brush member 2*e* of FIGS. 7 and 8 as well.

Figure 7:
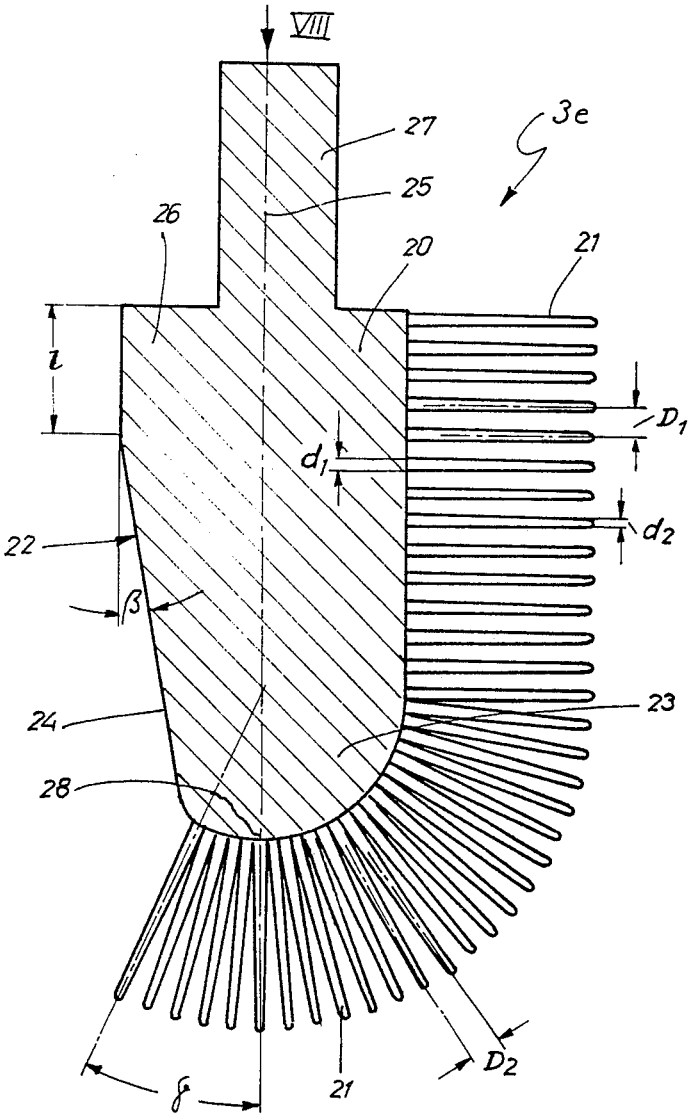
FIGS. 7 and 8 are views of a further design of tooth brush as part of the invention in lengthways section and in plan view looking in the direction of arrow XIII in FIG. 7.
Figure 8:
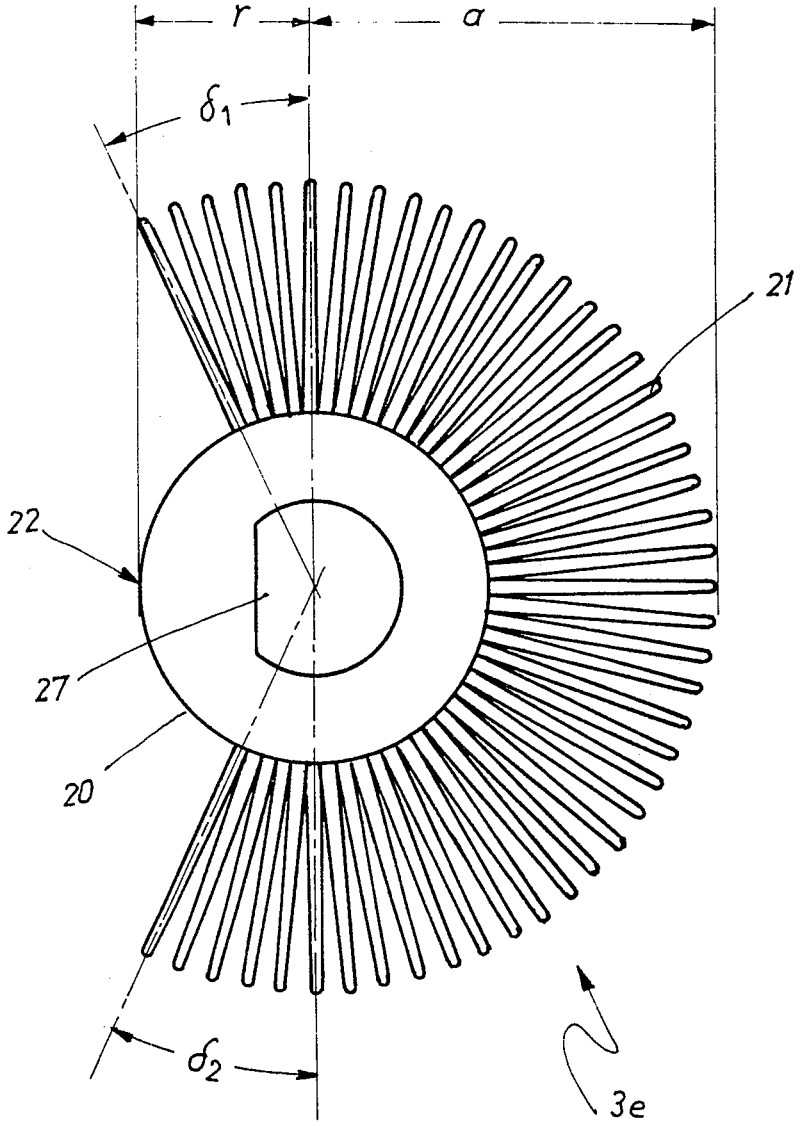

In FIGS. 7 and 8 the brush member 3*e* will be seen on a larger scale and it will be clear that the bristles 21, that are best made in one piece with the inner part or core of the brush, are directed generally radially outwards from the support pin 20', that is more or less cylindrical. The two opposite sides 22, turned away from each other, of the two support pins on the tooth brush are free of bristles, whereas the free outwardly crowned or ball-like ends of the support pins have bristles thereon. When the tooth brush is being used these bristles are pointed towards the gums and they are at an acute angle to the axis of the pins. Because the bristles are molded on as parts of single structure, they may be packed together more or less as densely as needed, this being more specially important at the end of the support pins in view of the fact that it is here that the bristles are directed outwards and away from each other.

All the bristles may be equal length. Moreover they become thinner towards their outer ends. The diameter $d_1$ of the bristles at their base or inner ends may for example be in a range of 0.23 to 0.25 mm, whereas at their outer ends the diameter $d_2$ may for example be in a range of 0.17 to 0.18 mm. The spacing $D_1$ and $D_2$ between the outer ends of the bristles from each other in the cylindrical and ball-like or outwardly crowned part of the pin end 23 may be equal and, for example, have a value of 0.6 mm. In the cylindrical part however it may be better to have a smaller spacing.

As part of a further useful development of the invention each support pin is designed with a slope so as to become thinner towards its free end on its bristle-free side 22 as will be seen from FIG. 7. In this respect the sloping part may as in the present example be a flat face 24, the sloping part best making an angle $\beta$ with the axis 25 of the pin. The value of $\beta$ may be about 10 deg. Because of this the amount of space needed is still further cut down and the user of the tooth brush will have no trouble into getting to the narrowest parts of the mouth. In the working example the sloping part of the bristle-free side 22 is next to a cylindrical part 26 of the support pin, that has a length 1 of, for example, 2 to 3 mm.

At its end opposite to the rounded or ball-like end 23 the support pin 20' has a middle axial male part 27 that is plugged into a hole in the handle part 1, such hole being in the arm of the handle at the point where the brush member is to be fixed in place. As a further useful design point, the support pin 20' has bristles thereon at positions past the rounded end 28, the bristles running out from each other at an angle $\gamma$ of about 20 deg to 30 deg, the best value being 25 deg. A further useful effect is to be had if the bristle-free part of the support pin 20' makes an angle at the axis of the pin 20' in a range of about 120 deg to 140 deg (see FIG. 8), the best value being generally 130 deg. This is made in keeping with the two angles $\delta_1$ and $\delta_2$ that each have a value of 25 deg, such angles being between a plane that is normal to a plane bisecting the said angle of 125 deg.

The radius of the support pin 20' may be about 3 mm and the spacing a between the axis of the pin 25 and the outer ends of the bristles may be about 7 mm. The overall length of the support pin 20' from the end 23 to the start of the male part 27 may be about 11 mm.

The design details noted in connection with FIGS. 7 and 8 may naturally be used in the other examples of the invention if desired.

Figure 5:
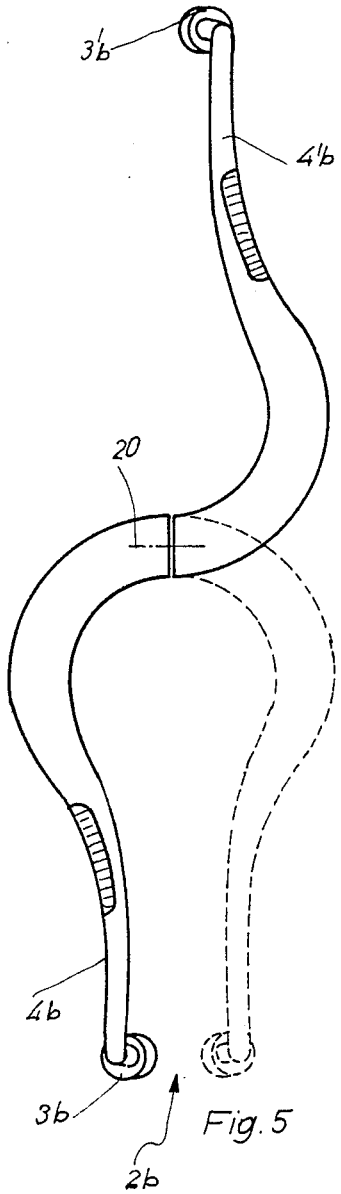
FIG. 5 is a view of a further possible form of tooth brush in keeping with the invention based on the design of FIGS. 1 to 3.

As a further possible development of the invention to be seen in FIG. 5 the two arms 4*b* and 4'*b* of the handle part 1*b* may be joined together so that they may be turned about the point of joining. The axis of turning is marked with a broken line. With this design it is possible for the two arms 4*b* and 4'*b* to be turned and be at different angles to each other. In the normal position of use (as marked in broken lines) the brush is much like the brush to be see in FIGS. 1 to 4. On the other hand if the one arm, as for example the arm 4'*b*, is turned through angle of about 180 deg (as marked in full lines), the teeth may be cleaned with one brush member only, if there is not enough room at a point in the mouth for the teeth to be brushed with the two brush members at once.

The embodiments of the invention in which an exclusive property or privilege is claimed are defined as follows:

1. A tooth brush for effecting a cleaning of human teeth and a massaging of the gums, comprising:

a handle having a pair of arms extending coextensively with respect to each other and each thereof lying in a first common plane, mutually adjacent ends at one end on each arm terminating in an elongate brush member supporting element extending outwardly of and on the same side of said first common plane;

means for facilitating a movement of said mutually adjacent ends toward and away from each other;

a pair of elongate brush members and coupling means for effecting a fixed coupling of each of said brush members to said brush member supporting elements, said brush members each extending outwardly of and on the same side of said first common plane, said brush members each having an elongate base with a first side oriented on said handle to face each other and a second side facing away from said first common plane, said first and second sides having a plurality of bristles emanating therefrom, said bristles emanating from said first sides each terminating in a first convex arcuate array when viewed in a direction along the longitudinal axis of said elongate base, axes of each said first convex arcuate array on each said base being oriented transversely of said first common plane and parallel to a second common plane defined by the longitudinal axes of said bases and which extends transversely of said first common plane, said bristles emanating from each said second sides terminating in a second convex arcuate array, the axes of which extend parallel to said second common plane, said bristles emanating from both said first and second sides terminating in a third convex arcuate array when viewed in a direction perpendicular to said second common plane, axes of said third convex arcuate array being oriented perpendicular to said second common plane.

2. The tooth brush according to claim 1, wherein the longitudinal axis of each said brush member extends in a plane generally parallel to said second common plane.

3. The tooth brush according to claim 2, wherein the longitudinal axes of said brush members are oriented at an acute angle to each other.

4. The tooth brush according to claim 3, wherein said acute angle is in the range of 20° to 30° when viewed in a direction perpendicular to said second common plane.

5. The tooth brush according to claim 1, wherein said first and second sides are convexly arced about axes oriented in said second common plane.

6. The tooth brush according to claim 1, wherein a third side on each said brush member opposite said first side is free of bristles and is inclined to said first common plane so that said third sides converge toward the free ends of each said brush member.

7. The tooth brush according to claim 1, wherein said first arcuate array of bristles extends through an angle in the range of 120° to 140° when viewed along the longitudinal axis of said elongate base.

8. The tooth brush according to claim 1, wherein said third convex arcuate array of bristles extends through an angle of 110° to 180° when viewed in a direction perpendicular to said second common plane.

9. The tooth brush according to claim 1, wherein each said bristle is integrally formed on said base and becomes thinner toward the outer ends thereof.

10. The tooth brush according to claim 1, wherein said coupling means includes an elongate peg on one of said arm and said base and a socket on the other of said arm and said base, said peg being received in said socket.

11. The tooth brush according to claim 1, wherein said peg and socket are correspondingly irregularly shaped to assure a proper orientation of said brush members on said handle.

12. The tooth brush according to claim 1, wherein said handle is U-shaped and integrally formed from a single piece of material, said arms thereof being resiliently flexible toward and away from each other, the portion of said handle adjoining said arms having an enlarged and arcuate exterior, the radius of said arcuate exterior being greater than a normal and unflexed position of said arms.

13. The tooth brush according to claim 1, wherein said second common plans is perpendicular to said first common plane.

14. The tooth brush according to claim 1, wherein said base includes additional sides, and wherein said first arcuate array includes bristles emanating from said additional sides and through an angle of 360° when viewed in a direction along the longitudinal axis of said elongate base.

15. The tooth brush according to claim 1, wherein said handle is U-shaped, said arms being pivotally secured to each other for movement about an axis extending parallel to said second common plane.

* * * * *

UNITED STATES PATENT AND TRADEMARK OFFICE

CERTIFICATE OF CORRECTION

PATENT NO. : 4 486 914

DATED : December 11, 1984

INVENTOR(S) : Staffan Planten and Trobjoern Askeroth

It is certified that error appears in the above-identified patent and that said Letters Patent is hereby corrected as shown below:

Column 8, line 3; change "claim 1" to ---claim 10---.

line 16; change "plans" to ---plane---.

Signed and Sealed this

*Twenty-first* Day of *May 1985*

[SEAL]

*Attest:*

DONALD J. QUIGG

*Attesting Officer* *Acting Commissioner of Patents and Trademarks*